US005539936A

United States Patent [19]

Thomas

[11] Patent Number: 5,539,936

[45] Date of Patent: Jul. 30, 1996

[54] SPORTS HELMET TRANSPARENT GUARD ASSEMBLY

[76] Inventor: Michael E. Thomas, 1044 E. 15th St., Winston-Salem, N.C. 27105

[21] Appl. No.: 553,045

[22] Filed: Nov. 3, 1995

[51] Int. Cl.[6] ..... A42B 3/18

[52] U.S. Cl. ..... 2/424; 2/9; 2/425

[58] Field of Search ..... 2/9, 10, 15, 410, 2/411, 422, 424, 425, 453, 6.3, 6.7

[56] References Cited

U.S. PATENT DOCUMENTS

| | | | |
|---|---|---|---|
| 3,751,728 | 8/1973 | Thompkins | 2/424 |
| 4,209,858 | 7/1980 | Coenen | 2/425 |
| 5,014,366 | 5/1991 | Discipio, Sr. | 2/424 |
| 5,101,517 | 4/1992 | Douglas | 2/424 |

*Primary Examiner*—Michael A. Neas

[57] ABSTRACT

A sports helmet transparent guard assembly adapted for use in association with a sports helmet having opposing side regions with C-shaped recesses positioned therein, the apparatus comprising: a transparent guard device fabricated of transparent materials, the guard device including a support bar formed in a generally semicircular configuration with two ends, coupling devices being positioned along the support bar, a side flap being formed in an arcuate generally circular configuration, each side flap having a linear upper end coupled to an end of the support bar, each side flap adapted to be positioned in the C-shaped recesses of the helmet in an operative orientation, the support bar being coupled to the upper cross bar of the face mask to secure the guard device in place, the transparent face guard providing users with increased peripheral visibility to avoid injuries while participating in contact sports.

4 Claims, 3 Drawing Sheets

SPORTS HELMET TRANSPARENT GUARD ASSEMBLY

BACKGROUND OF THE INVENTION

1. Field of the Invention

The present invention relates to a sports helmet transparent guard assembly and more particularly pertains to providing users with increased peripheral visibility to avoid injuries while participating in contact sports.

2. Description of the Prior Art

The use of protective head gear is known in the prior art. More specifically, protective head gear heretofore devised and utilized for the purpose of protecting a user's head from outside forces are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,101,517 to Douglas a sports helmet with transparent windows in the side walls.

U.S. Pat. No. 5,014,366 to Discipio, Sr., discloses an enhanced visibility helmet.

U.S. Pat. No. 5,056,156 to Kosmo discloses a helmet of a laminate construction of polycarbonate and polysulfane polymeric material.

U.S. Pat. No. Des. 341,230 to Kamata discloses a shield plate for a helmet.

U.S. Pat. No. Des. 331,474 to Lehtonen discloses a helmet with visor.

U.S. Pat. No. 4,663,785 to Comparetto discloses a transparent-translucent fluidic head protector.

U.S. Pat. No. 4,605,000 to Anguita discloses a greenhouse helmet.

U.S. Pat. No. 4,233,689 to Baron discloses a protective headgear.

Lastly, U.S. Pat. No. 5,287,562 to Rush III discloses a helmet to protect cervical spine against axial impact forces.

In this respect, the sports helmet transparent guard assembly according to the present invention substantially departs from the conventional concepts and designs of the prior art, and in doing so provides an apparatus primarily developed for the purpose of providing users with increased peripheral visibility to avoid injuries while participating in contact sports.

Therefore, it can be appreciated that there exists a continuing need for a new and improved sports helmet transparent guard assembly which can be used for providing users with increased peripheral visibility to avoid injuries while participating in contact sports. In this regard, the present invention substantially fulfills this need.

SUMMARY OF THE INVENTION

In view of the foregoing disadvantages inherent in the known types of protective head gear now present in the prior art, the present invention provides an improved sports helmet transparent guard assembly. As such, the general purpose of the present invention, which will be described subsequently in greater detail, is to provide a new and improved sports helmet transparent guard assembly and method which has all the advantages of the prior art and none of the disadvantages.

To attain this, the present invention essentially comprises a new and improved sports helmet transparent guard assembly comprising, in combination: a sports helmet formed in a hollow generally semispherical configuration with a top region, a rear region, two side regions, an open front region and an open lower region, the helmet further including a circular ear hole extending through each side region, each side region having a C-shaped recess formed above each ear hole; a face mask formed in a generally rectangular configuration with an upper region and a lower region, the upper region having an upper extent including a cross bar, the lower region including a plurality of intersecting bars, the face mask being coupled around the open front region of the sports helmet; and a transparent guard device fabricated of transparent fiberglass, the guard device including a support bar formed in an elongated generally semicircular configuration with two ends and a center point, two fastening clips each being formed in a planar looped configuration, each fastening clip including a snap device to permit releasable coupling around the cross bar of the face mask, one clip being positioned between the approximate center point and an end of the support bar, two transparent side flaps each being formed in an arcuate generally circular configuration, each side flap having a linear upper end coupled to an end of the support bar, each side flap adapted to be positioned in the C-shaped recesses of the helmet in an operative orientation, the fastening clips being coupled to the upper cross bar of the face mask to secure the guard device in place, the guard device providing users with increased peripheral visibility to avoid injuries while participating in contact sports.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sports helmet transparent guard assembly which has all of the advantages of the prior art protective head gear and none of the disadvantages.

It is another object of the present invention to provide a new and improved sports helmet transparent guard assembly which may be easily and efficiently manufactured and marketed.

It is further object of the present invention to provide a new and improved sports helmet transparent guard assembly which is of durable and reliable constructions.

An even further object of the present invention is to provide a new and improved sports helmet transparent guard assembly which is susceptible of a low cost of manufacture with regard to both materials and labor, and which accordingly is then susceptible of low prices of sale to the consuming public, thereby making such sports helmet transparent guard assembly economically available to the buying public.

Still yet another object of the present invention is to provide a new and improved sports helmet transparent guard assembly which provides in the apparatuses and methods of the prior art some of the advantages thereof, while simultaneously overcoming some of the disadvantages normally associated therewith.

Still another object of the present invention is to provide users with increased peripheral visibility to avoid injuries while participating in contact sports.

Lastly, it is an object of the present invention to provide a new and improved a sports helmet transparent guard assembly adapted for use in association with a sports helmet having opposing side regions with C-shaped recesses positioned therein, the apparatus comprising: a transparent guard device fabricated of transparent materials, the guard device including a support bar formed in a generally semicircular configuration with two ends, coupling devices being positioned along the support bar, a side flap being formed in an arcuate generally circular configuration, each side flap having a linear upper end coupled to an end of the support bar, each side flap adapted to be positioned in the C-shaped recesses of the helmet in an operative orientation, the support bar being coupled to the upper cross bar of the face mask to secure the guard device in place, the transparent face guard providing users with increased peripheral visibility to avoid injuries while participating in contact sports.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
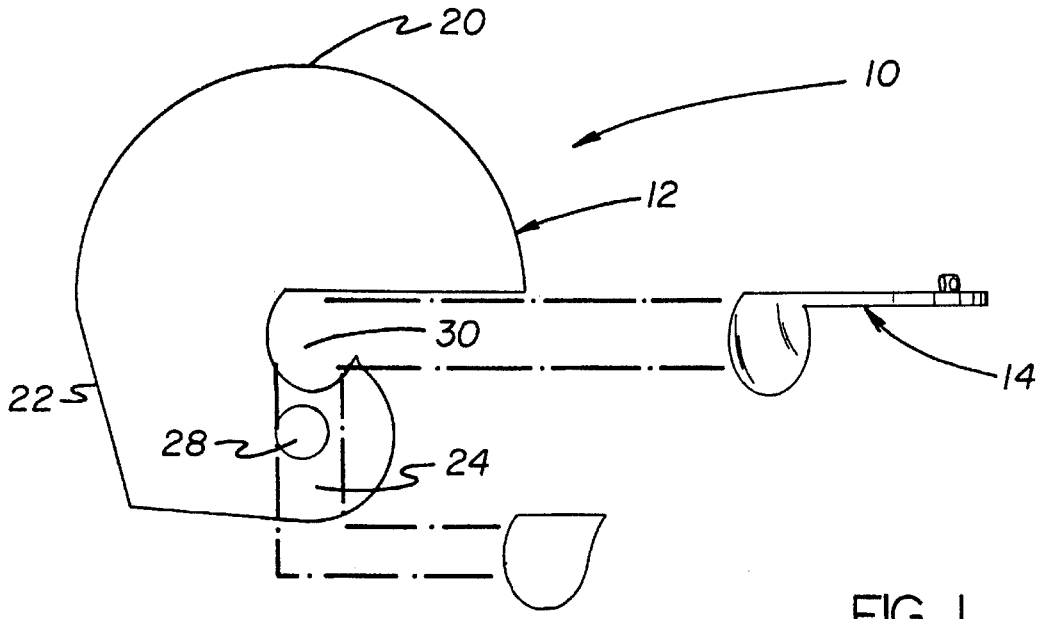
FIG. 1 is a perspective view of the preferred embodiment of the sports helmet transparent guard assembly constructed in accordance with the principles of the present invention.

With reference now to the drawings, and in particular to FIG. 1 thereof, the preferred embodiment of the new and improved sports helmet transparent guard assembly embodying the principles and concepts of the present invention and generally designated by the reference numeral 10 will be described.

The present invention, the sports helmet transparent guard assembly 10 is comprised of a plurality of components. Such components in their broadest context include a sports helmet 12, a transparent guard device 14 and two fastening clips 16. Such components are individually configured and correlated with respect to each other so as to attain the desired objective.

More specifically, the sports helmet 12 is formed in a hollow generally semispherical configuration with a top region 20, a rear region 22, two side regions 24, an open front region 26 and an open lower region. The helmet further includes a circular ear hole 28 extending through each side region. The outer surface of the sports helmet is fabricated of rigid elastomeric materials to protect the user's head from impact forces. In varying embodiments of the apparatus the sports helmet is configured to be used for football, hockey, or other contact sports. In some embodiments a sports helmet is not included with the apparatus. Rather, an existing sports helmet is modified by cutting a C-shaped recess into the helmet. In the preferred embodiment each side region has an upper extent including a C-shaped recess 30 formed within it. Note FIG. 1.

Figure 2:
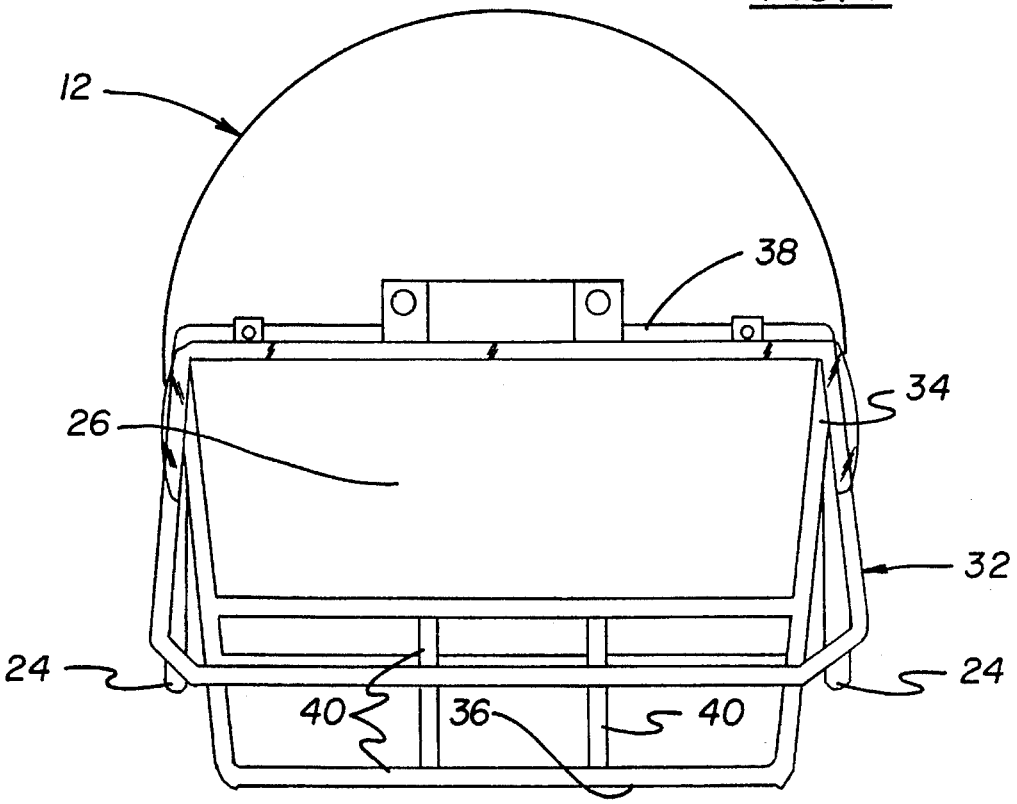
FIG. 2 is a front perspective view of the apparatus in a fully assembled orientation.

A face mask 32 is formed in a generally rectangular configuration with an upper region 34 and a lower region 36. The face mask is fabricated of rigid elastomeric materials to protect the user's face from impact forces. In some embodiments the face mask has a rubberized coating around it. The upper region has an upper extent including a cross bar 38. The crossbar is curved to fit transversely across the helmet. The lower region includes a plurality of intersecting bars 40. The face mask is positioned around the open front region 26 of the sports helmet. The cross bar is coupled to the lower extent of the top section of the helmet. Note FIG. 2.

A transparent guard device 14 is fabricated of transparent fiberglass. In alternative embodiments of the apparatus the guard device is manufactured of other types of semirigid materials. The guard device includes a support bar 42 formed in an elongated, generally semicircular configuration with two ends 44 and a center point. The support bar is semirigid thereby permitting some degree of flexibility to contour to differently sized and shaped sports helmets. Two fastening clips 16 are formed in a planar looped configuration. Each fastening clip includes a snap device 46 to permit releasable coupling around the crossbar of the face mask.

Figure 3:
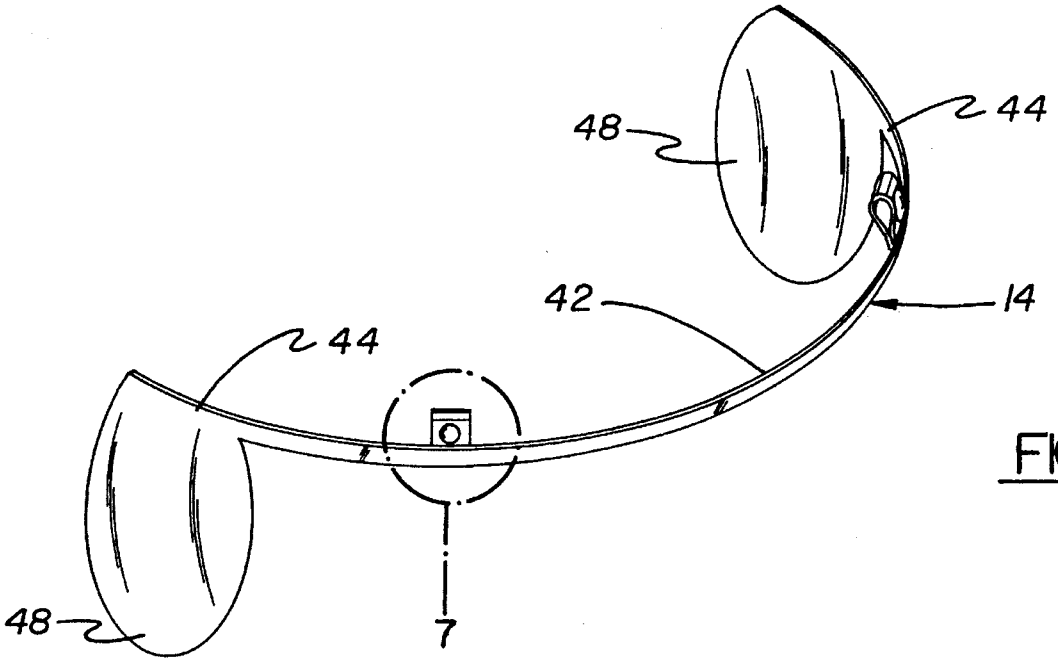
FIG. 3 is an isolated perspective view of the transparent guard device.
Figures 5, 6, 7:
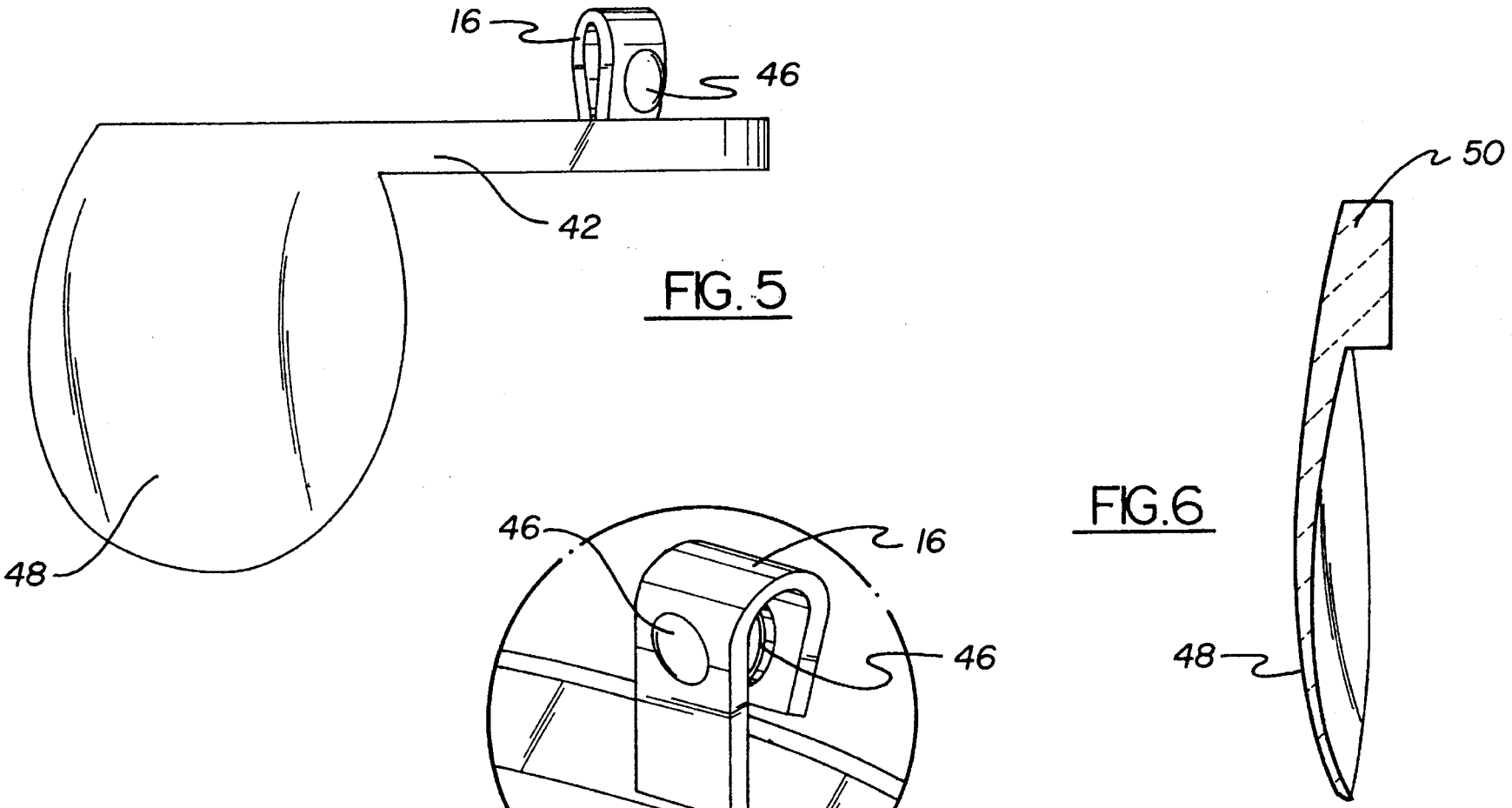
FIG. 5 is an enlarged perspective view of a side flap and fastening clip of the apparatus.
FIG. 6 is a cross sectional view of a side flap of the apparatus.
FIG. 7 is an isolated perspective view of the fastening clip of the apparatus.

One clip is positioned between the approximate center point and each end of the support bar. The positioning of the clips provides maximum stability for the guide device. Note FIGS. 2, 3 and 7.

Figure 4:
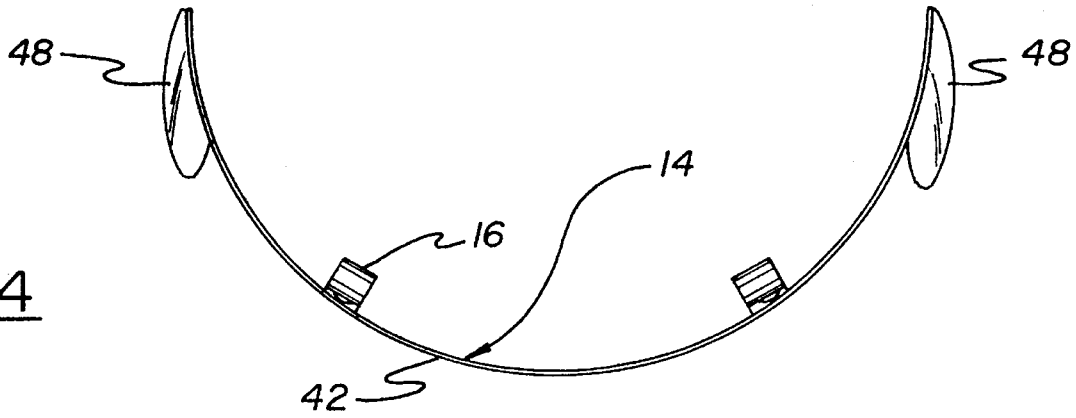
FIG. 4 is a top plan view of the transparent guard device.

Two transparent side flaps 48 are formed in an arcuate generally circular configuration. The side flaps are fabricated of rigid transparent fiberglass. Each side flap has a linear upper end 50 coupled to an end of the support bar. Each side flap is adapted to be positioned in the C-shaped recesses of the helmet in an operative orientation. The side flaps are precisely contoured to friction fit securely within the C-shaped recesses. The side flaps protect users from impact forces while also providing them with increased peripheral visibility to avoid injuries while participating in contact sports. Injuries often occur when athletes are struck form the side without having seen the approaching opponent. Note FIGS. 4, 5 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the marts of the invention, to include variations fen size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sports helmet transparent guard assembly comprising, in combination:

a sports helmet formed in a hollow generally semispherical configuration with a top region, a rear region, two side regions, an open front region and an open lower region, the helmet further including a circular ear hole extending through each side region, each side region having a C-shaped recess formed above each ear hole;

a face mask formed in a generally rectangular configuration with an upper region and a lower region, the upper region having an upper extent including a cross bar, the lower region including a plurality of intersecting bars, the face mask being coupled around the open front region of the sports helmet; and a transparent guard device fabricated of transparent fiberglass, the guard device including a support bar formed in an elongated generally semicircular configuration with two ends and a center point, two fastening clips each being formed in a planar looped configuration, each fastening clip including a snap device to permit releasable coupling around the cross bar of the face mask, one clip being positioned between the approximate center point and an end of the support bar, two transparent side flaps each being formed in an arcuate generally circular configuration, each side flap having a linear upper end coupled to an end of the support bar, each side flap adapted to be positioned in the C-shaped recesses of the helmet in an operative orientation, the fastening clips being coupled to the upper cross bar of the face mask to secure the guard device in place, the guard device providing users with increased peripheral visibility to avoid injuries while participating in contact sports.

2. A sports helmet transparent guard assembly adapted for use in association with a sports helmet having opposing side regions with C-shaped recesses positioned therein, the apparatus comprising:

a transparent guard device fabricated of transparent materials, the guard device including a support bar formed in a generally semicircular configuration with two ends, coupling devices being positioned along the support bar, a side flap being formed in an arcuate generally circular configuration, each side flap having a linear upper end coupled to an end of the support bar, each side flap adapted to be positioned in the C-shaped recesses of the helmet in an operative orientation, the support bar adapted to be coupled to an upper cross bar of a face mask to secure the guard device in place, the transparent face guard providing users with increased peripheral visibility to avoid injuries while participating in contact sports.

3. The sports helmet transparent guard assembly as set forth in claim 2 and further including:

a sports helmet formed in a hollow generally semispherical configuration with a top region, a rear region, two side regions, an open front region and an open lower region, the helmet further including a circular ear hole extending through each side region, each side region having a C-shaped recess formed above each ear hole, a face mask formed in a generally rectangular configuration with an upper region and a lower region, the upper region having an upper extent including a cross bar, the lower region including a plurality of intersecting bars, the face mask being coupled around the open front region of the sports helmet.

4. The apparatus as set forth in claim 2 wherein the coupling devices of the support bar are a plurality of fastening clips, each fastening clip being formed in a planar looped configuration and including a snap device, the fastening clips adapted to be releasably coupled around the upper cross bar of the face mask.

* * * * *